US008203059B2

(12) United States Patent
Miloslavsky

(10) Patent No.: US 8,203,059 B2
(45) Date of Patent: Jun. 19, 2012

(54) BRACE FOR STRINGED INSTRUMENTS

(76) Inventor: Gennady Miloslavsky, Brooklyn, NY (US)

( * ) Notice: Subject to any disclaimer, the term of this patent is extended or adjusted under 35 U.S.C. 154(b) by 157 days.

(21) Appl. No.: 12/692,716

(22) Filed: Jan. 25, 2010

(65) Prior Publication Data

US 2011/0179937 A1 Jul. 28, 2011

(51) Int. Cl.
*G10D 3/04* (2006.01)

(52) U.S. Cl. ..... 84/291; 84/267; 84/298; 84/307

(58) Field of Classification Search ..... 84/291
See application file for complete search history.

(56) References Cited

U.S. PATENT DOCUMENTS

| | | | | |
|---|---|---|---|---|
| 519,416 | A | 5/1894 | Turner | |
| 1,116,754 | A | 11/1914 | Storle | |
| 3,892,159 | A | 7/1975 | Houtsma | |
| 3,974,730 | A | 8/1976 | Adams, Jr. | |
| 4,026,181 | A | 5/1977 | Barcus et al. | |
| 4,253,371 | A | 3/1981 | Guice | |
| 4,840,103 | A * | 6/1989 | Mayer | 84/297 R |
| 5,052,269 | A | 10/1991 | Young, Jr. | |
| 5,260,505 | A * | 11/1993 | Kendall | 84/298 |
| 5,549,027 | A * | 8/1996 | Steinberger et al. | 84/297 R |
| 5,661,252 | A * | 8/1997 | Krawczak | 84/291 |
| 5,895,872 | A * | 4/1999 | Chase | 84/291 |
| 6,191,350 | B1 * | 2/2001 | Okulov et al. | 84/646 |
| 7,411,121 | B2 | 8/2008 | McGill | |
| 7,462,767 | B1 | 12/2008 | Swift | |
| 2006/0075879 | A1 | 4/2006 | Ushinski | |
| 2007/0209496 | A1 | 9/2007 | Lenzi | |
| 2008/0190263 | A1 | 8/2008 | Drew | |

* cited by examiner

*Primary Examiner* — Elvin G Enad
*Assistant Examiner* — Christopher Uhlir
(74) *Attorney, Agent, or Firm* — Antonio Papageorgiou; Ostrow Kaufman LLP

(57) ABSTRACT

A stringed musical instrument is provided that includes a brace disposed within the hollow chamber of the musical instrument such that the first end of the brace is in contact with the inner side of the soundboard of the musical instrument at a point longitudinally at or above the bridge saddle toward the top end of the instrument. At the second end, the brace is in contact with an inner side of the body at a point longitudinally below the bridge saddle toward the bottom end of the musical instrument. The strings pass over the bridge saddle, through at least one hole in the bridge, and at least one of the strings attaches to the brace directly or indirectly at a point on the brace. The brace receives tension from the at least one string attached to the brace and transfers the tension from the strings to at least the contact point of the first end of the brace.

18 Claims, 6 Drawing Sheets

BRACE FOR STRINGED INSTRUMENTS

BACKGROUND OF THE INVENTION

The present application relates to stringed instruments, and more particularly to methods and systems for bracing acoustic string instruments.

Acoustic stringed instruments, such as guitars, generally have a hollow body with strings that extend longitudinally from the top end, e.g., the headstock, to some point near on at the bottom end, e.g., the bridge or tail block, of the instrument. Between the ends of the strings lies a bridge that maintains the strings a certain distance above the soundboard of the stringed instrument. This design creates a great deal of stress on the soundboard at the bridge, which has led some to add bracing to the soundboard in the interior of the hollow body, such as the bracing systems proposed in U.S. Pat. Nos. 519,416; 1,116,754, 3,892,159; 3,974,730; 4,026,181; 4,253,371; 5,052,269; 5,260,505; 5,549,027; 7,411,121; and 7,462,767, each of which are incorporated herein by reference. These systems, however, have numerous shortcomings Many are difficult and thus costly to produce. More importantly, many of these systems limit the ability of the stringed instrument to produce sounds at low frequencies.

Accordingly, there is a need for a bracing system for use with stringed instruments that does not exhibit one or all of the shortcomings associated with known systems for bracing musical instruments.

SUMMARY OF THE INVENTION

In one embodiment, a stringed musical instrument is provided that includes: a headstock at a first end of the musical instrument; a body comprising: a soundboard at a second end of the musical instrument opposite the first end, the soundboard having an outer side and an inner side; a back, and at least one side having an inner side that extends between the soundboard and the back to create a hollow chamber within a body of the musical instrument; a plurality of strings that extend between the first and the second ends of the musical instrument; a bridge disposed on the outer side of the soundboard; a bridge saddle disposed on an outer side of the bridge; and a brace having a first end and a second end. The brace is disposed within the hollow chamber of the musical instrument such that the first end of the brace is in contact with the inner side of the soundboard at a point longitudinally at or above the bridge saddle toward the first end of the musical instrument, and the second end of the brace is in contact with an inner side of the body at a point longitudinally below the bridge saddle toward the second end of the musical instrument. The strings pass over the bridge saddle through at least one hole in the bridge and at least one of the strings attaches to the brace directly or indirectly at a point on the brace. The brace receives tension from the at least one string attached to the brace and transfers the tension from the strings to at least the contact point of the first end of the brace.

In one embodiment, the instrument includes a tail block disposed within the hollow chamber of the body toward the second end of the musical instrument and the second end of the brace comes into contact with the tail block. The tail block may have a groove therein and the second end of the brace may come into contact with the tail block at the groove. Tail block may instead have a seat attached thereto and the second end of the brace comes into contact with the tail block at the seat.

In one embodiment, the body includes an extension disposed between the soundboard and the brace at the first end of the brace. In this instance, the extension separates the first end of the brace from the soundboard inward toward the body of the instrument and the brace at the second end comes into contact with the soundboard at a point longitudinally below the bridge saddle toward the second end of the musical instrument In one embodiment, the brace has an aperture disposed therein and at least one of the strings attach removably to the brace at the aperture and apply tension directly to the brace at the aperture. The aperture may have a key-hole shape and at least one of the strings has a ball end that fits into and secures the strings to the aperture.

In one embodiment, the brace is not fixedly connected to the soundboard at least the first end of the brace.

In one embodiment, the body includes a support member that attaches to the inside of the soundboard at the bridge and to the brace, the strings attach to the bridge, and the support member transfers tension from the bridge to the brace indirectly.

In one embodiment, the body further includes a bridge plate disposed within the body between the inner side of the soundboard and the first end of the brace.

In one embodiment, the body includes at least one stop disposed on the inside of the soundboard at or near the first point of the brace that limits the brace from moving at least longitudinally at the first point.

In one embodiment, the brace has a planer structure, a length extending longitudinally in the body, and a width extending laterally in the body. The width may be about 60 mm to about 80 mm In one embodiment, the brace has at least one relief cut that extends through the brace at the first end and creates a plurality of fingers at the first end. In this instance, at least one string attaches to a first finger and at least one string attaches to a second finger on the brace. The brace may have at least one finger for each string and at least one string attaches to each finger. Each finger may have a width of about 5 mm to about 15 mm.

In one embodiment, the brace has a plurality of relief cuts that extend radially from a common point.

In one embodiment, the brace is beveled at the first end.

In one embodiment, a stringed musical instrument is provided that includes a headstock at a first end of the musical instrument; a body comprising: a soundboard at a second end of the musical instrument opposite the first end, the soundboard having an outer side and an inner side, a back, and at least one side having an inner side that extends between the soundboard and the back to create a hollow chamber within a body of the musical instrument; a plurality of strings that extend between the first and the second ends of the musical instrument; a tail block disposed within the hollow chamber of the body toward the second end of the musical instrument; a bridge disposed on the outer side of the soundboard; a bridge saddle disposed on an outer side of the bridge; and a brace having a first end and a second end, a plurality of relief cuts that extend through the brace to create at least one finger at the first end of the brace for each string attached to the brace, and a key-hole shaped apertures disposed in each finger. The brace is disposed within the hollow chamber of the musical instrument such that the first end of the brace is in contact with the inner side of the soundboard at a point longitudinally at or above the bridge saddle toward the first end of the musical instrument, and the second end of the brace is in contact with the inner side of the body at the tail block. The strings pass over the bridge saddle through at least one hole in the bridge and each of a plurality of strings attaches removably to the brace directly at one of the apertures in the brace, and the brace receives tension from the at least one string attached to the brace and transfers the tension from the strings to at least the contact point of the first end of the brace.

Additional aspects of the present invention will be apparent in view of the description which follows.

DETAILED DESCRIPTION OF THE INVENTION

Figure 1:
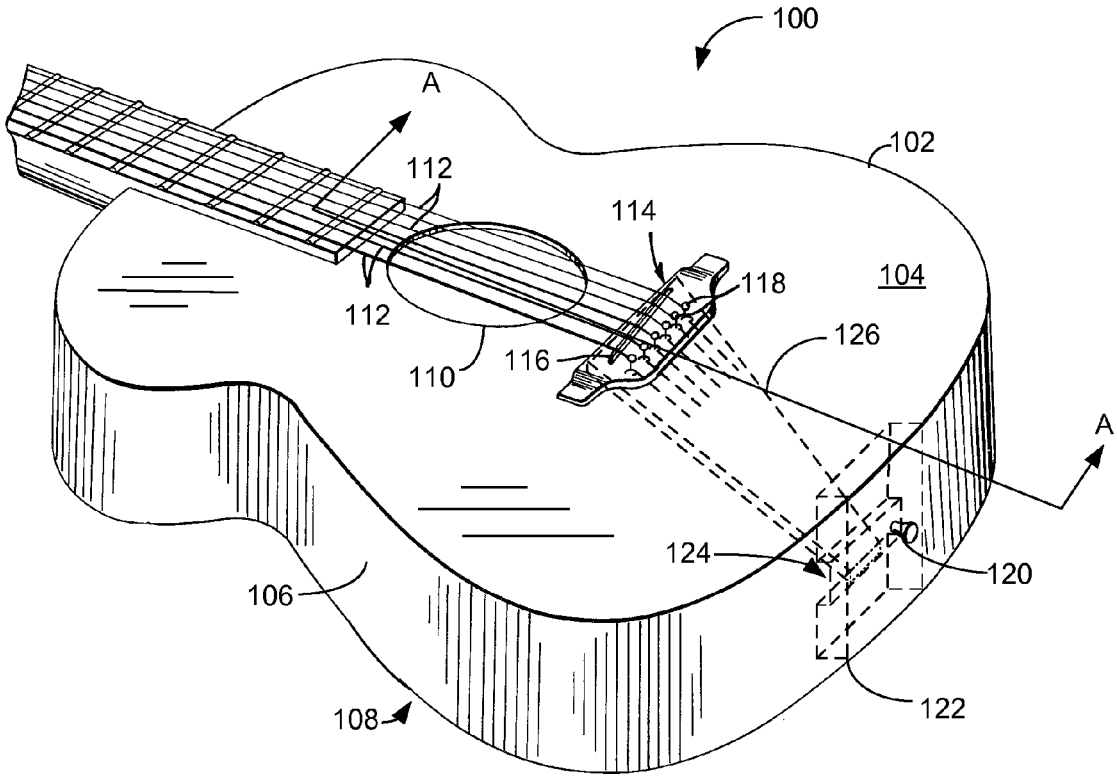
FIG. 1 is a perspective view of a stringed instrument with a brace therein according to at least one embodiment of the braces discussed herein.

Referring to FIG. 1, in at least one embodiment, the present application provides a stringed instrument 100 having a hollow body 102 with an aperture 110. The body 102 is made up of a soundboard or top 104, a back 108, and sides 106. The instrument 100 further includes strings 112 that extend between the head stock and the tail block 122 of the instrument 100. The strings 112 are suspended a desired distance above the soundboard 104 with a bridge saddle 116. The bridge saddle 116 is supported on the soundboard 104 with a bridge 114. The bridge 114 generally secures the strings at the lower end of the body 102 and it amplifies the sound of the strings 112 by transferring the strings 122 vibrations to the soundboard 104. The strings 112 are secured to the bridge 114 through holes 118 therein. Although a guitar may be discussed herein as an example of a stringed instrument, it is understood that various other stringed instruments can benefit from the present application, including a bass, cello, violin, etc. Accordingly, the present application is not limited to any one type of musical instrument.

The following convention will be used to describe the relationship between the parts of the musical instrument: "longitudinal" shall be a direction essentially inline with the tail block 122 and the head stock where "up" or "above" denotes a direction toward the headstock and "down" or "below" denotes a direction toward the tail block 122; "lateral" shall be a direction essentially perpendicular to the longitudinal direction; "in" shall be a direction from the soundboard 104 toward the back 108; and "out" shall be a direction from the back 108 toward the soundboard 104.

In one embodiment, the instrument 100 includes a brace 126 that loosely connects the soundboard 104 to the tail block 124 of the instrument 100. That is, the brace 126 is installed within the body 102 of the musical instrument 100 so that it is not attached fixedly to the tail block 124 and/or at the bridge 114 at the respective contact points. In this instance, the brace 126 may be held against the bridge 114 with the force of the strings 112 or some other means for mechanically securing the brace 126 to instrument. The brace 126 preferably contacts the bridge 114 from the inside of the body 102 at a point longitudinally at or above the bridge saddle 116. This beneficially eliminates or counteracts, respectively, the moment or torque created by the strings 112 on the soundboard 104. In this respect, the brace 126 allows the musical instrument 100 to be constructed with less bracing (not shown) or without any bracing against the inside of the soundboard 104. With less or without any bracing, the brace 126 further allows the soundboard 104 to vibrate more freely thereby enhancing low frequency sound production.

Figure 2:
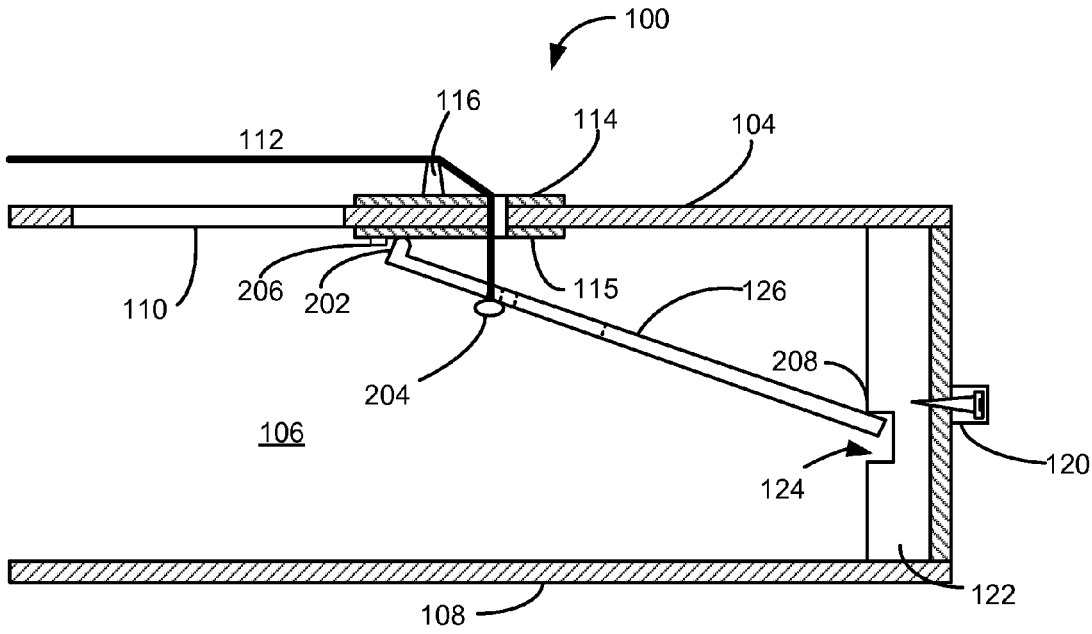
FIG. 2 is a cross sectional view of a stringed instrument with a brace therein according to at least one embodiment of the braces discussed herein.

FIG. 2 is a cross sectional view of a musical instrument 100 of FIG. 1, which includes strings 112 that pass over the bridge saddle 116 and through holes in the bridge 114. In this instance, the instrument includes a bridge plate 115 disposed within the body 102 opposite the bridge 114. The holes 118 therefore pass through the bridge 114, the soundboard 104, and the bridge plate 115. In this embodiment, the brace 126 is held loosely in place within the body 102 of the musical instrument 100 with the tension of the strings 112. That is, the strings 112 are removably attached to the brace 126 at a point 204 between the ends 202 and 206 of the brace 126. As can be seen, the attachment point 204 of the strings 112 to the brace 126 is longitudinally below the bridge saddle 116.

The brace 126 generally receives the tension from the strings 112 and transfers the force therefrom to contacts points 202 and 206 at the ends of the brace 126. The lower end of the brace 126 comes into contact with the tail block 122 at contact point 208 while the upper end of the brace 126 comes into contact with the bridge plate 115 at contact point 202. The contact point 202 is preferably a point longitudinally at or above the bridge saddle 116, as shown. The contact point 208 may be a point on the tail block 122 in from the soundboard 104 thereby disposing the brace 126 in the instrument 100 diagonally inward from the bridge 114 toward the tail block 122. Various ways may be used to connect the brace 126 to the tail block 122 at point 208, such as with a groove 124 that the brace 126 sits in, as shown in FIG. 2, or with a seat 306 attached to the tail block 122 that the brace 126 sits, on as shown in FIG. 3.

As noted herein, the brace 126 is preferably not fixed at the contact points 202, 206. In this instance, there is no restriction on longitudinal and/or lateral movement except that from the frictional forces acting between the brace 126 and the bridge plate 115 and/or the tail block 122. Although friction provides significant resistance, a stop 206 may be installed on the bridge plate 115 to prevent or otherwise limit the brace 126 from moving longitudinally and/or laterally, for example, when the tension in the strings 112 is released.

The strings 112 may be attached to the brace 126 at 204 in various ways. In one embodiment, the brace 126 includes a key hole-shaped aperture that extends through the brace 126. The aperture is preferably sized so that the ball end of a string may pass through one end of the aperture while not being able to pass through another end. Strings are attached to the brace 126 by passing the ball end of the string through the bridge 114 at hole 118 and the larger opening of the aperture, sliding the ball end toward the smaller opening of the aperture, followed by pulling tension on the string and securing the opposite end of the string to the tuning peg in the headstock. In this embodiment, pins are not required to secure the strings 112 to the bridge 114.

Figure 3:
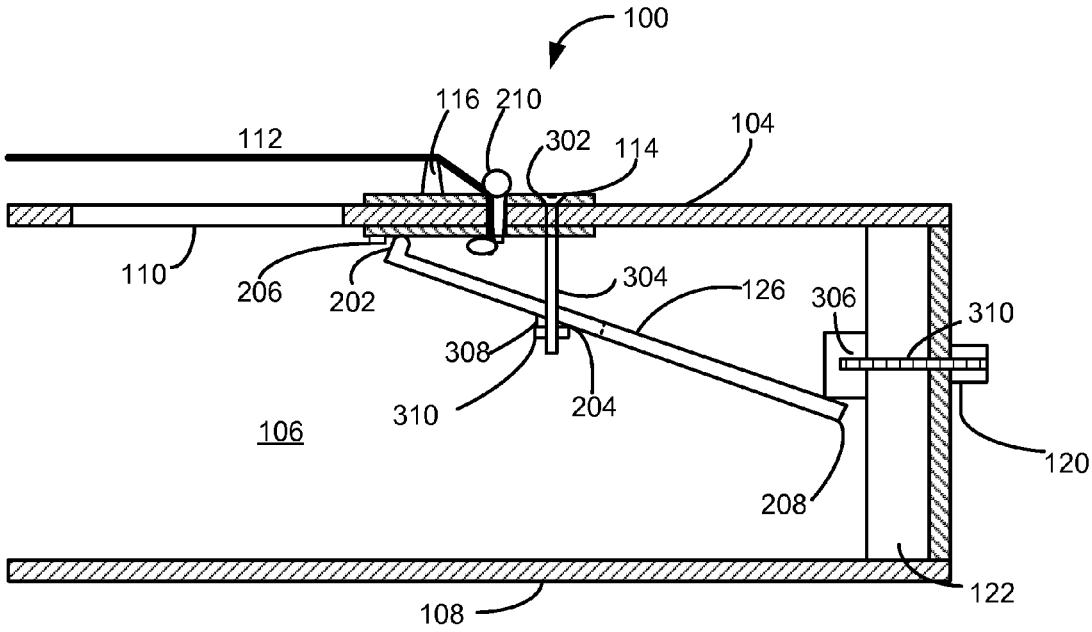
FIG. 3 is a cross sectional view of a stringed instrument with a brace therein according to at least one other embodiment of the braces discussed herein.

Referring to FIG. 3, in one embodiment, the brace 126 is held against the bridge plate 115 with a support member 304. The member 304 generally transfers some or all of the tension from the strings 112 on the bridge 114 to the brace 126, which in turn transfers that load to contact points 202 and 208. It is understood that various types of support members may be used in this regard. For instance, the support member 304 may be a threaded rod or screw 302 that passes through the bridge 114, the soundboard 104, and the bridge plate 115, and that connects to the brace 126 at point 204. The connection at point 204 may be accomplished in a variety of ways. For example, the brace 126 may include threads at point 204 that allow the screw 302 to be threaded into the brace 126. Alternatively, the screw 304 may pass through the brace 126 at point 204 and be secured thereto with a nut 310. A wedged shape washer 308 may be installed between the brace 126 and the nut 310 to distribute the load accordingly. In this embodiment, the strings 112 may be connected to the bridge 114 with pins 210 or any other means for doing so.

As noted herein, the connection at point 208 may also vary. For example, a seat 306 may be attached to the tail block 122 with a screw 310 that passes through the tail block 122 at the shoulder strap connection point 120. This beneficially allows the brace 126 to be retrofitted to existing musical instruments with relative ease.

Figure 4:
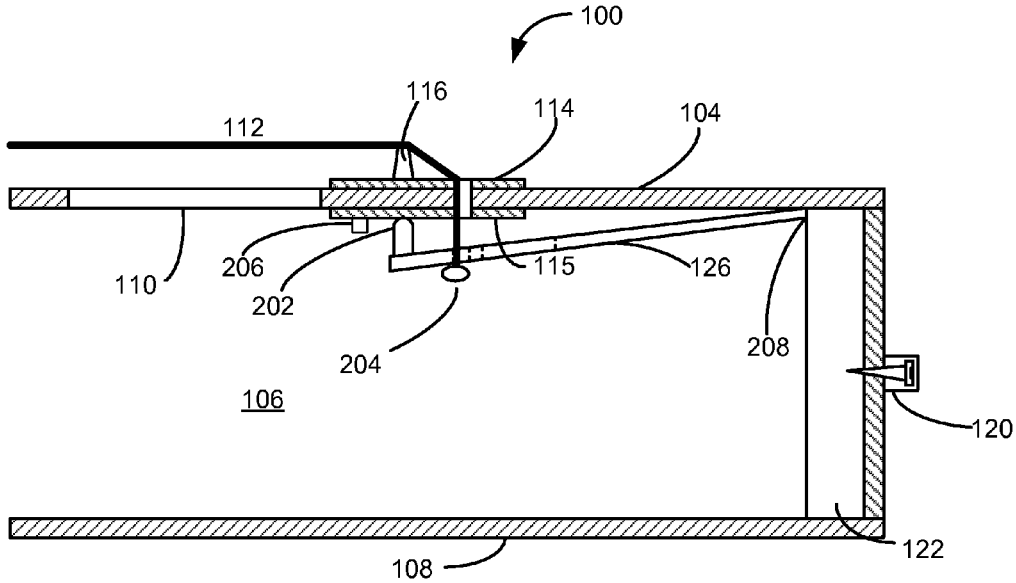
FIG. 4 is a cross sectional view of a stringed instrument with a brace therein according to at least one other embodiment of the braces discussed herein.
Figure 5:
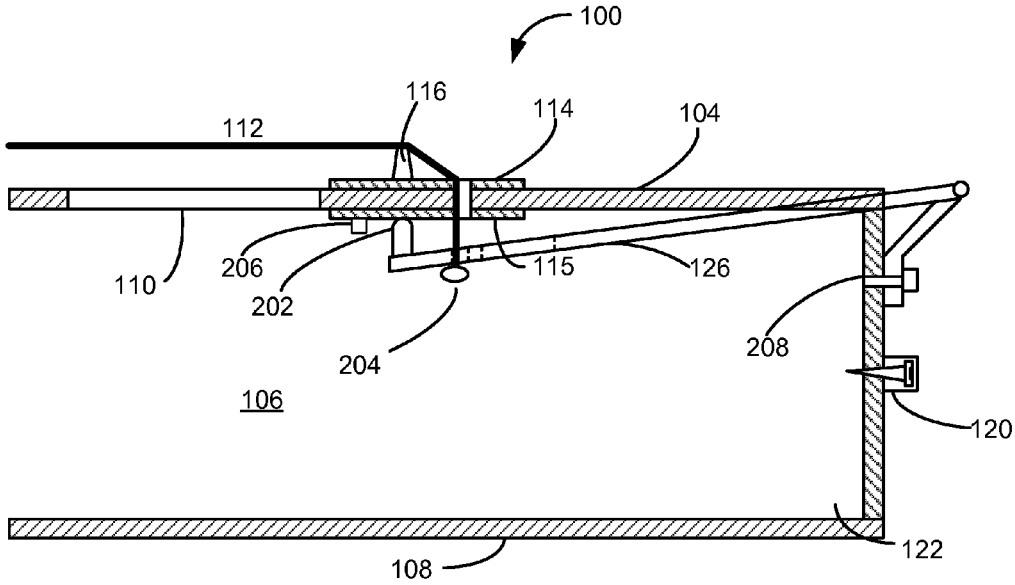
FIG. 5 is a cross sectional view of a stringed instrument with a brace therein according to at least one other embodiment of the braces discussed herein.

Referring to FIG. 4, the brace 126 may be installed at other points on the tail block 122 so that the brace 126 is other than diagonally inward from the bridge 114 toward the tail block 122. For instance, the brace 126 may be installed so that it is essentially parallel to the soundboard 104 (not shown) or diagonally inward from the tail block 122 to the bridge 114 (as shown). The brace 126 may also be installed so that it is fixed to the tail block 122 in order to restrict longitudinal movement. In this instance, stop 206 would not be necessary. In FIG. 5, the brace 126 may be installed in an instrument without a tail block with a bracket that ties the brace to the bottom side of the guitar as shown.

Figure 6:
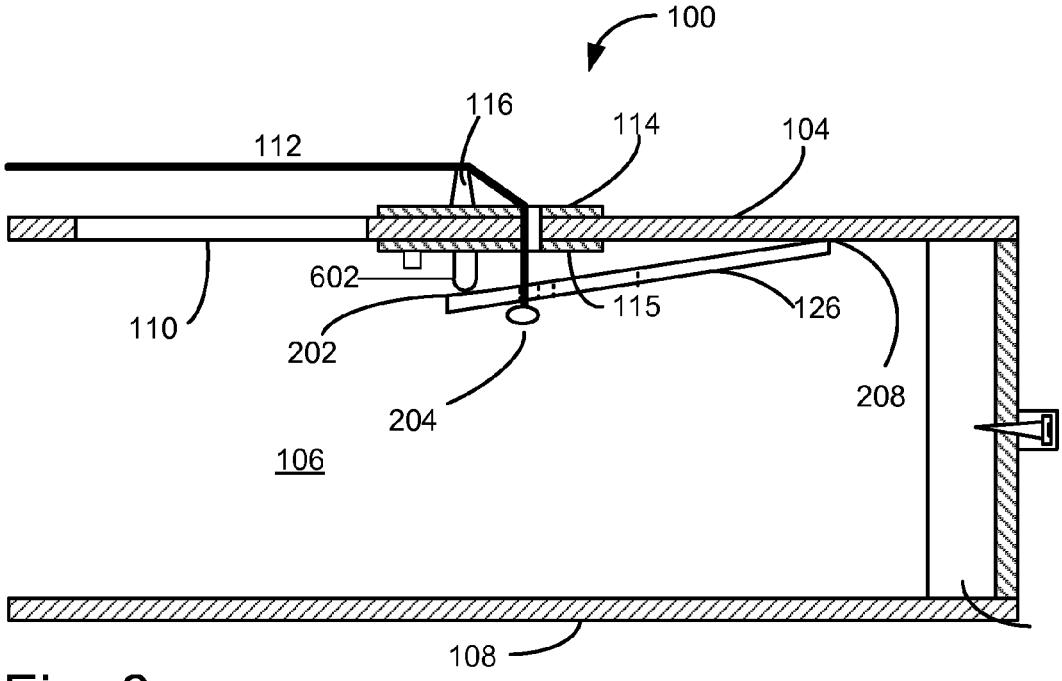
FIG. 6 is a cross sectional view of a stringed instrument with a brace therein according to at least one other embodiment of the braces discussed herein.

Although the brace 126 may have been shown with a beveled edge that extends outward from the surface of the brace 126 at point 202, it is understood that this extension need not necessarily be part of the brace 126. For example, the extension 602 may be a part of or otherwise be disposed on the bridge plate 115 at point 202, as shown in FIG. 6. In this instance, the brace itself is an essentially flat planer structure. Moreover, the brace 126 need not be installed on the tail block 122 or on the side 129 of the body 102 at the bottom of the instrument. For example, the brace 126 at point 208 may be in contact with the soundboard 104 at a location longitudinally downward from the bridge 114, as also shown in FIG. 6

Figure 7:
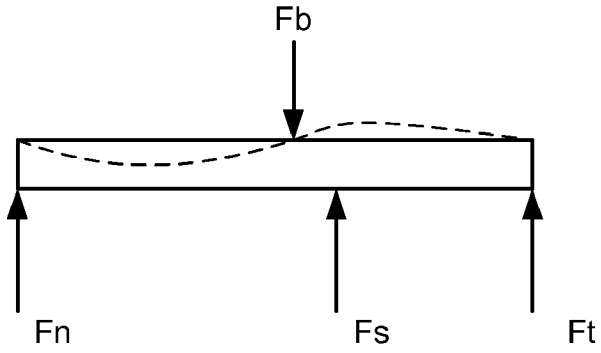
FIG. 7-9 are diagrams that depict loading conditions on the soundboard of a stringed musical instrument with a brace therein according to at least one other embodiment of the braces discussed herein.
Figure 8:
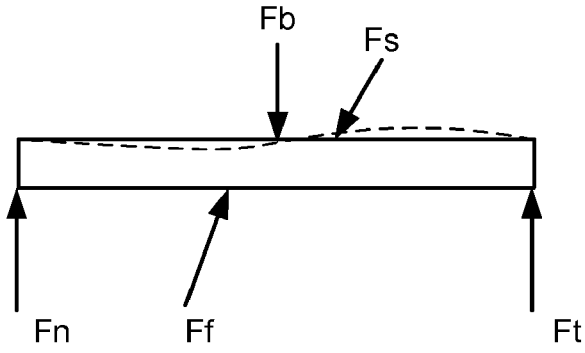
Figure 9:
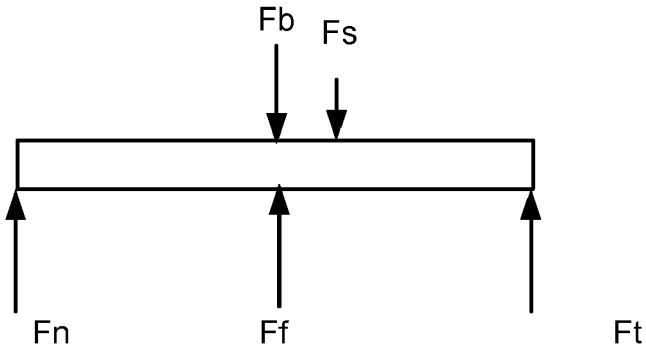

FIGS. 7-9 show various loading conditions on stringed musical instruments. FIG. 7 depicts the loading condition on a soundboard without the brace discussed herein. In this instance, a torque is created by forces Fb and Fs on the soundboard that cause the soundboard to twist in an "s" shape. In FIG. 8, with the brace installed at a contact point longitudinally above the saddle, the forces Ff and Fb create a torque inverse to that in FIG. 6. In FIG. 9, with the brace installed at a contact point longitudinally at the saddle, the torque is greatly reduced if not eliminated altogether. The brace may be installed longitudinally with respect to the bridge to create a neutral condition, i.e., to minimize the torque caused on the soundboard by the forces acting thereon.

Figure 10:
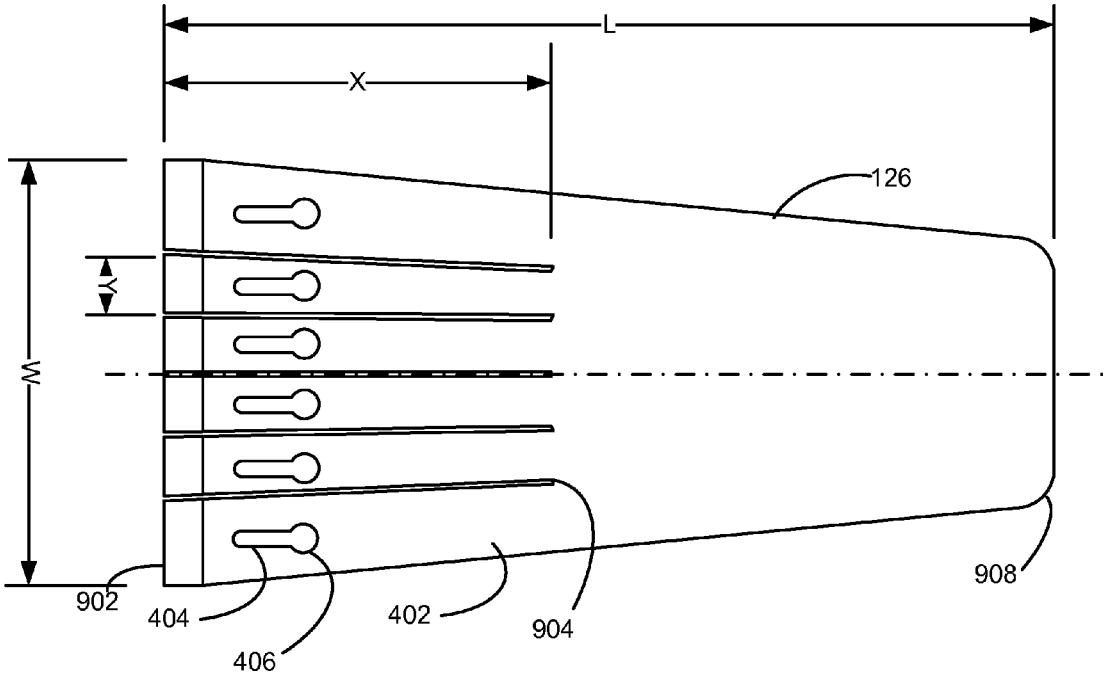
FIG. 10 is a top view of a brace therein according to at least one embodiment of the braces discussed herein.

FIG. 10 depicts a brace 126 according to at least one embodiment of the braces discussed herein. The brace 126 generally includes a first end 902 and a second end 908 opposite the first end 902. The first end 902 abuts against the bridge plate 115 at contact point 202 and the second end at contact point 208. This brace 126 is generally a relatively thin plate having a major dimension with a length L and a minor dimension with a width W. Installed, the major dimension extends longitudinally whereas the minor dimension extends laterally in the body of the instrument.

The dimensions L and W may vary to fit the particular instrument. For example, W will vary depending on the number of strings, e.g., 6 strings vs. 8 strings, and the spacing of the strings. L will similarly vary depending on the type of instrument and the particular design of the body. For example, a brace 126 for a cello will likely be longer than a brace 126 for a guitar. For a six string guitar, the brace 126 may have a width W of about 70 mm +/− 10 mm.

The brace 126 may have any desired shape so as to fit within the body 102 of the musical instrument 100. The brace, for instance, may have a square, a rectangular, or a trapezoidal shape as shown. The corners of the brace 126 where the sides meet may be angles or curved, also as shown.

The brace 126 preferably includes therein apertures or other means for attaching the strings 112 thereto. The aperture may include a first opening 406 and a second opening 404 that is smaller than the first opening. This key-hole shaped aperture generally allows the ball end of the strings to be passed through the larger opening 406 and to be locked into the smaller opening 404. The distance between the aperture and the first end 902 of the brace 126 may vary based on the desired offset between the contact point 202 and the bridge saddle 116, and the relevant dimensions of the musical instrument 100. As noted herein, various other means may be used to removably fasten the strings 112 to the brace 126.

The brace 126 may have a continuous planer structure or it may have reliefs 904 in the planer structure that extend through the brace to create a plurality of fingers 402 at the first end 902 of the brace 126. The number of fingers 402 may vary anywhere from 2 to 12 or more depending on factors, such as the number of strings. For example, the brace 126 may be designed to have one finger 402 for every string of the instrument 100. In this instance, the brace 126 preferably includes an aperture or other string attachment means on each finger 402. The length X of the relief may vary, however, for a six string guitar X may be about 80 mm +/− 10 mm. The width Y of the finger 402 may similarly vary, however, for the six string guitar Y may be about 10 mm +/− 5 mm The relief cuts themselves may be parallel to each other or they may extend radially from a common point as shown.

Figure 11:
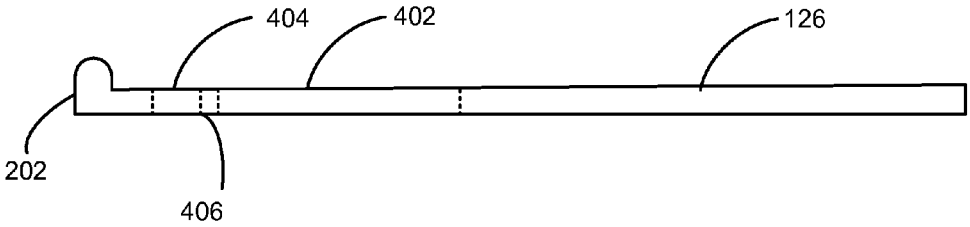
FIG. 11 is a side view of a brace therein according to at least one embodiment of the braces discussed herein.

FIG. 11 depicts a side view of the brace according to FIG. 9. As noted above, the brace 126 may have a planar structure. The structure generally has a thickness that may vary depending on the application. For example, a thicker brace may be desired when a relatively long brace is required whereas a thinner brace may be desired when a shorter brace is required. The thickness may also vary based on the material that the brace is made out of. For example, a thinner material may be used when the brace is made of a relatively strong material. The thickness of the brace for the six string guitar, for instance, may be from about 1 mm to about 10 mm.

The ends of the brace 126 may be flat, such as at end 908, or at least one of the ends, such as end 902, may include, e.g., a quarter or half round, beveled end. The beveled end may be at the same or below the level of the upper surface of the brace 126 or it may extend outward from the upper surface as shown. The degree that that the beveled end extends outward will vary, again, based on the particular application of the brace. As noted above, the extension created by the beveled end may instead be disposed on the bridge plate 115 instead of the brace 126.

The brace 126 may be constructed from various materials. For example, the brace 126 may be made out of wood, such as a hardwood, plastic, or composite materials, such as carbon fiber, fiberglass, etc. The brace 126 may also be made from a combination of materials. For example, the brace 126 may be made of a plurality of layers of these materials, such as a wood layer sandwiched between carbon fiber layers.

While the foregoing invention has been described in some detail for purposes of clarity and understanding, it will be appreciated by one skilled in the art, from a reading of the disclosure, that various changes in form and detail can be made without departing from the true scope of the invention in the appended claims.

What is claimed is:

1. A stringed musical instrument comprising:

a headstock at a first end of the musical instrument;

a body comprising:

a soundboard at a second end of the musical instrument opposite the first end, the soundboard having an outer side and an inner side;

a back; and at least one side having an inner side that extends between the soundboard and the back to create a hollow chamber within a body of the musical instrument;

a plurality of strings that extend between the first and the second ends of the musical instrument;

a bridge disposed on the outer side of the soundboard, the bridge having a plurality of holes that extend through the soundboard into the chamber;

a bridge saddle disposed on an outer side of the bridge; and a brace having a first end and a second end, and a structure between the first and second ends, the structure having a planer surface facing toward the soundboard, wherein the brace is disposed within the hollow chamber of the musical instrument such that the first end of the brace is in contact with the inner side of the soundboard at a point longitudinally at or above the bridge saddle toward the first end of the musical instrument, and the second end of the brace is in contact with an inner side of the body at a point longitudinally below the bridge saddle toward the second end of the musical instrument, wherein the brace is disposed within the chamber so as to create a gap between the soundboard and the planer surface facing outward of the brace at a point below the holes in the bridge, wherein at least one of the strings pass over the bridge saddle through at least one of the holes in the bridge and the soundboard, and across the gap between the soundboard and the outward facing surface of the brace, and wherein the at least one of the strings attaches to the brace at the point below the holes in the bridge, and wherein the brace receives tension from the at least one string attached to the brace and transfers the tension from the strings to at least the contact point of the first end of the brace; wherein the brace is loosely coupled to the soundboard and held in place against the bridge only with force provided by the at least one string.

2. The stringed instrument of claim 1, comprising a tail block disposed within the hollow chamber of the body toward the second end of the musical instrument and wherein the second end of the brace comes into contact with the tail block.

3. The stringed instrument of claim 2, wherein the tail block has a groove therein and the second end of the brace comes into contact with the tail block at the groove.

4. The stringed instrument of 2, wherein the tail block has a seat attached thereto and the second end of the brace comes into contact with the tail block at the seat.

5. The stringed instrument of claim 1, the body comprising an extension disposed between the soundboard and the brace at the first end of the brace, wherein the extension separates the first end of the brace from the second end comes into contact with the soundboard at a point longitudinally below the bridge saddle toward the second end of the musical instrument.

6. The stringed instrument of claim 1, wherein the brace has an aperture disposed therein and at least one of the strings attach removably to the brace at the aperture and apply tension directly to the brace at the aperture.

7. The stringed instrument of claim 6, wherein the aperture has a key-hole shape and at least one of the strings has a ball end that fits into and secures the strings to the aperture.

8. The stringed instrument of claim 1, wherein the brace is not fixedly connected to the soundboard at at least the first end of the brace.

9. The stringed instrument of claim 1, the body further comprising a bridge plate disposed within the body between the inner side of the soundboard and the first end of the brace.

10. The stringed instrument of claim 1, the body comprising at least one stop disposed on the inner side of the soundboard at or near the first end of the brace that limits the brace from moving at least longitudinally at the first end.

11. The stringed instrument of claim 1, wherein the brace has a plate-like planer structure with an essentially uniform thickness between opposing planer surfaces, a length extending longitudinally in the body, and a width extending laterally in the body.

12. The stringed instrument of claim 11, wherein the width is about 60 mm to about 80 mm.

13. The stringed instrument of claim 11, wherein the brace has at least one relief cut that extends through the brace at the first end and creates a plurality of fingers at the first end, and wherein at least one string attaches to a first finger and at least one string attaches to a second finger on the brace.

14. The stringed instrument of claim 13, wherein the brace has at least one finger for each string and at least one string attaches to each finger.

15. The stringed instrument of claim 13, wherein each finger has a width of about 5 mm to about 15 mm.

16. The stringed instrument of claim 11, wherein the brace has a plurality of relief cuts that extend radially from a common point.

17. The stringed instrument of claim 1, wherein the brace has a rounded beveled at the first end.

18. A stringed musical instrument comprising:

a headstock at a first end of the musical instrument;

a body comprising:

a soundboard at a second end of the musical instrument opposite the first end, the soundboard having an outer side and an inner side;

a back; and at least one side having an inner side that extends between the soundboard and the back to create a hollow chamber within a body of the musical instrument;

a plurality of strings that extend between the first and the second ends of the musical instrument;

a tail block disposed within the hollow chamber of the body toward the second end of the musical instrument;

a bridge disposed on the outer side of the soundboard, the bridge having a plurality of holes that extend through the soundboard into the chamber;

a bridge saddle disposed on an outer side of the bridge; and a brace having a first end and a second end, and a structure between the first and second ends, the structure having a planer surface facing toward the soundboard, a plurality of relief cuts that extend through the brace to create at least one finger at the first end of the brace for each string attached to the brace, and a key-hole shaped aperture disposed in each finger, and wherein the brace is disposed within the hollow chamber of the musical instrument such that the first end of the brace is in contact with the inner side of the soundboard at a point longitudinally at or above the bridge saddle toward the first end of the musical instrument, and the second end of the brace is in contact with the inner side of the body at the tail block, wherein the brace is disposed within the chamber so as to create a gap between the soundboard and the planer surface facing outward of the brace at a point below the holes in the bridge, wherein the strings pass over the bridge saddle through at least one of the holes in the bridge and the soundboard, and across the gap between the soundboard and the outward facing surface of the brace, and wherein each of a plurality of strings attaches removably to the brace at one of the apertures in the brace, below the holes in the bridge, and wherein the brace receives tension from the at least one string attached to the brace and transfers the tension from the strings to at least the contact point of the first end of the brace; wherein the brace is loosely coupled to the soundboard and held in place against the bridge only with force provided by the at least one string.

* * * * *